US009322166B2

(12) United States Patent
Rice

(10) Patent No.: US 9,322,166 B2
(45) Date of Patent: Apr. 26, 2016

(54) FLUSH MOUNT BRICK VENEER ANCHOR CAP

(71) Applicant: Bailey Metal Products Limited, Concord (CA)

(72) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 14/145,921

(22) Filed: Dec. 31, 2013

(65) Prior Publication Data

US 2015/0184375 A1 Jul. 2, 2015

(51) Int. Cl.
*E04B 1/38* (2006.01)
*E04B 2/10* (2006.01)
*E04B 1/41* (2006.01)

(52) U.S. Cl.
CPC ..... *E04B 2/10* (2013.01); *E04B 1/4178* (2013.01)

(58) Field of Classification Search
CPC ..... E04B 1/38; E04B 1/4178; E04B 1/7636; E04B 1/7616
USPC ..... 52/710–715, 565, 552
See application file for complete search history.

(56) References Cited

U.S. PATENT DOCUMENTS

| | | | | |
|---|---|---|---|---|
| 4,373,314 | A * | 2/1983 | Allan | 52/434 |
| 6,925,768 | B2 * | 8/2005 | Hohmann et al. | 52/513 |
| 7,225,590 | B1 * | 6/2007 | diGirolamo et al. | 52/379 |
| 7,966,784 | B2 * | 6/2011 | Wobber | 52/513 |
| 8,201,374 | B2 * | 6/2012 | Hohmann, Jr. | 52/379 |

* cited by examiner

*Primary Examiner* — Rodney Mintz
*Assistant Examiner* — Daniel Kenny

(57) ABSTRACT

A flush mount masonry veneer anchor for mounting on an exterior wall and tying a masonry veneer to the exterior wall, the masonry veneer anchor comprising an anchoring portion with anchor holes to receive a suitable fastener to attach the anchoring portion to an exterior surface of the exterior wall and a tie wire holding portion extending perpendicularly from the anchoring portion, the tie wire holding portion having one end connected to the anchoring portion and having a slot in an opposite end for holding a tie wire for tying the masonry veneer to the exterior wall, the anchor holes being in line with the tie wire holding portion to transfer extrusion and compression loads exerted on the tie wire holding portion directly through fasteners in the anchor holes to the exterior wall without an offset of a plane of the transfer of the forces.

12 Claims, 3 Drawing Sheets

FLUSH MOUNT BRICK VENEER ANCHOR CAP

FIELD OF THE INVENTION

The present invention is related to flush mount brick veneer anchors for mounting on an exterior wall and tying a masonry veneer to the exterior wall. In particular, the present invention is related to flush mount brick veneer anchor having an anchoring portion with anchor holes for attaching to the exterior surface of an exterior wall and a tie wire holding portion extending perpendicularly from the anchoring portion to hold a tie wire for tying a masonry veneer to the exterior wall. The anchoring holes are in line with the tie wire holding portion.

BACKGROUND OF THE INVENTION

Cavity walls of a masonry veneer tied to a stud backup wall are commonly utilized in construction to provide for an esthetically pleasing appearance while being less expensive than solid masonry walls. One common type of cavity wall used in both residential and commercial buildings is a brick veneer tied to a stud backup wall.

The brick veneer is tied to the stud backup wall by use of masonry or brick veneer anchors. There are two types of such anchors in common use. Flush mount anchors which mount to the exterior of the stud backup wall, and through the wall anchors which pass through the exterior wall covering and are mounted to the side of the stud in the interior of the wall cavity. Flush mount brick veneer anchors offer the advantage that it is not necessary to cut or pierce the covering material for the stud backup wall in order to install the anchors. This can maintain the integrity of the properties of the exterior covering of the stud backup wall as well as being simpler to install.

One disadvantage of flush mount anchors is that such anchors are generally L-shaped with the base of L providing an anchor plate for attachment to the stud backup wall and the leg of the L provide a tie wire holding portion with a slot at its end through which a brick tie wire is inserted. The brick tie wire is mortared between two rows of bricks to provide a secure connection between the brick veneer and backup wall. The disadvantage of this type of construction is that the mounting holes are placed in the anchor plate to the side of the brick tie portion and thus any compression or extension forces exerted through the brick tie wire to the brick veneer anchor are offset from the anchor points which can cause the anchor plate to pivot about the anchor points and weaken the connection between the anchor plate and the stud backup wall. This offset can also result in damage to the exterior covering as the anchor plate rotates about the anchor points.

There thus remains a need for a flush mount brick veneer anchor which transfers the load from the tie wire holding portion directly through the anchor points to the stud backup wall.

SUMMARY OF THE INVENTION

The present invention provides for a flush mount masonry veneer anchor for mounting on an exterior wall and tying a masonry veneer to the exterior wall. The masonry veneer anchor comprises an anchoring portion with anchor holes to receive a suitable fastener to attach the anchoring portion to an exterior surface of the exterior wall and a tie wire holding portion extending perpendicularly from the anchoring portion. The tie wire holding portion has one end connected to the anchoring portion and having a slot in an opposite end for holding a tie wire for tying the masonry veneer to the exterior wall. The anchor holes are provided in the anchoring portion above and below and in line with the tie wire holding portion to transfer extension and compression loads exerted on the tie wire holding portion directly through fasteners in the anchor holes to the exterior wall without an offset of a plane of the transfer of the forces.

In one aspect of the invention, the height of the anchoring portion is greater than the height of the tie wire holding portion and extends above and below the tie wire holding portion, the anchor holes being located in the portion of the anchoring plate above and below and in line with the tie wire holding portion.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
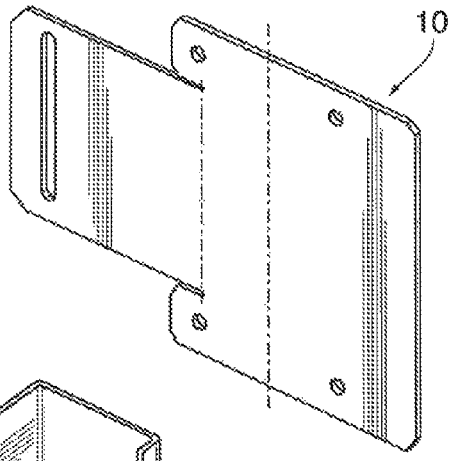
FIG. 1 is a perspective view of the blank from which a first preferred embodiment of the flush mount brick veneer anchor of the present invention is formed.
Figure 2:
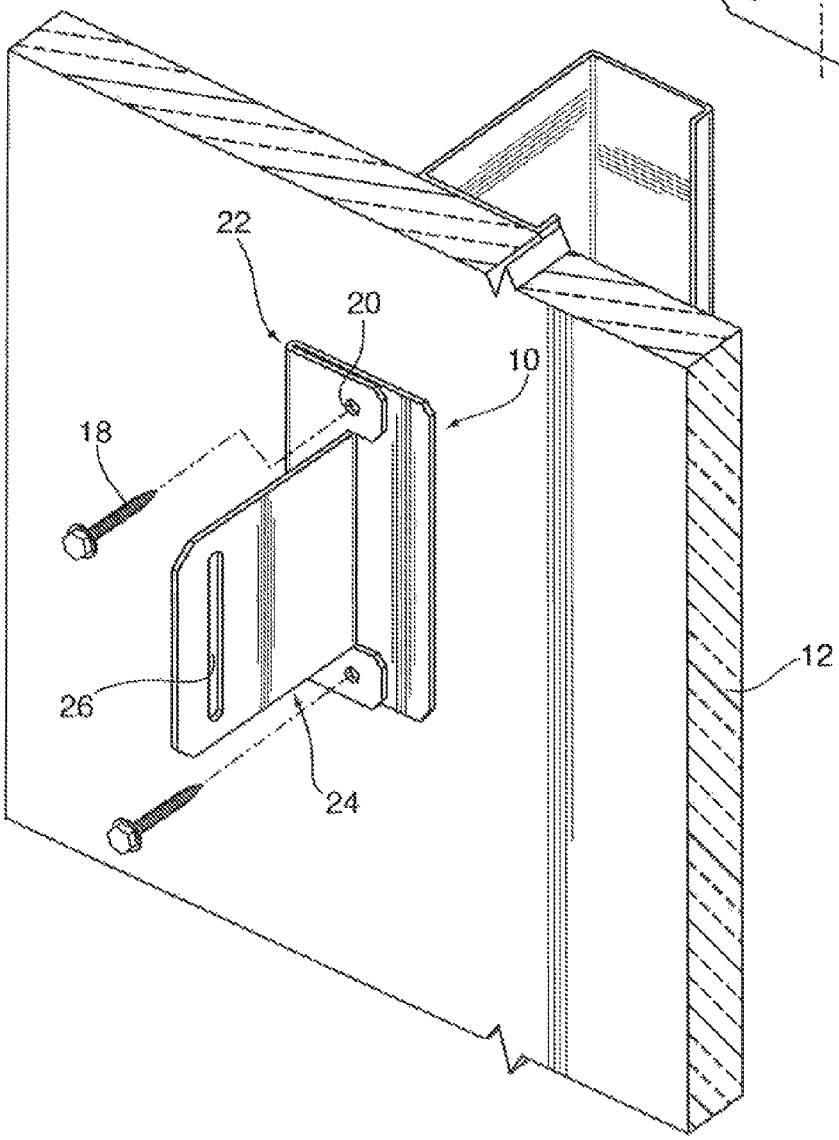
FIG. 2 is a perspective view illustrating the formed flush mount brick veneer anchor of FIG. 1 in the process of being mounted to an exterior wall.
Figure 3:
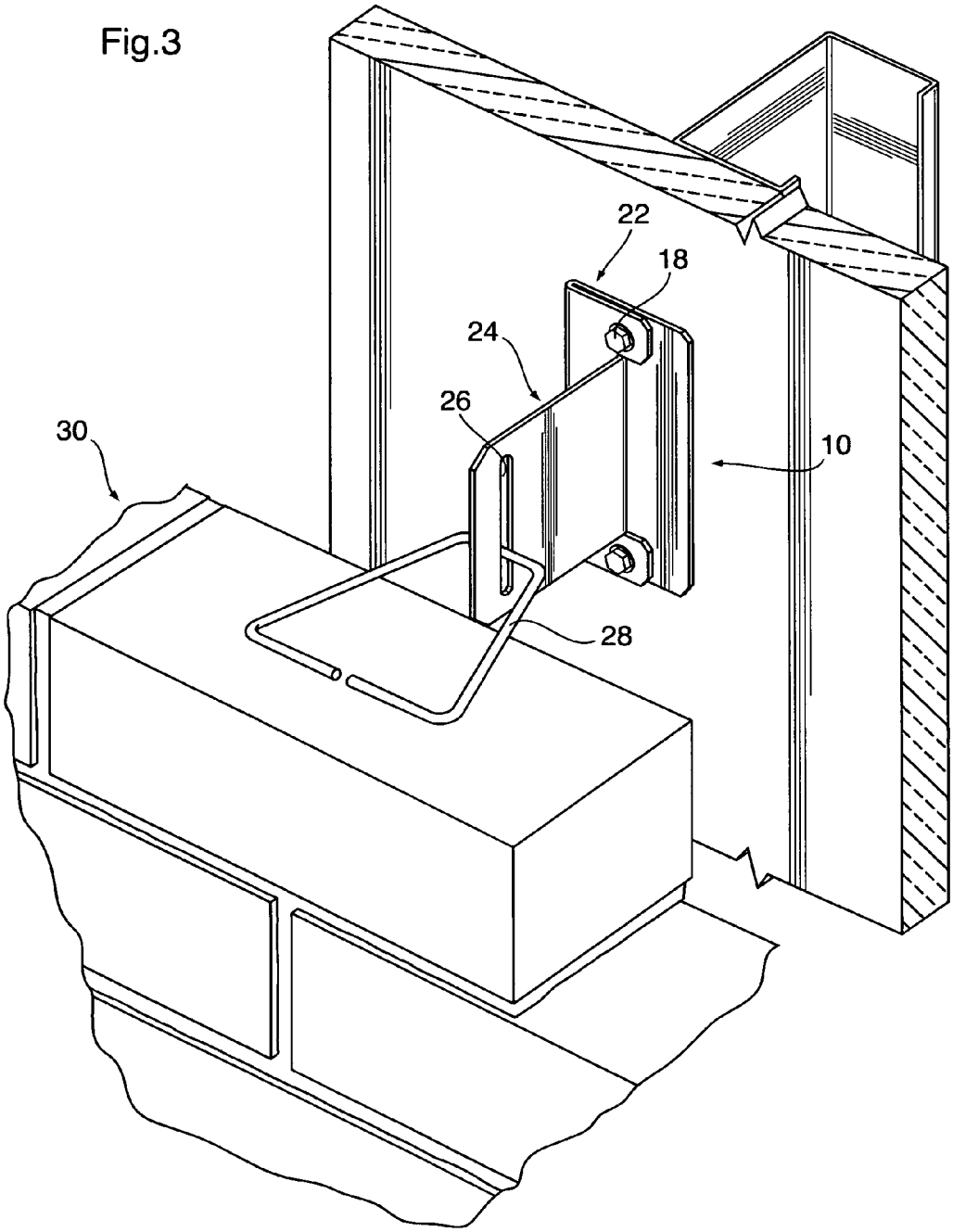
FIG. 3 is a perspective view of the use of the flush mount brick veneer anchor of FIG. 1 for tying a brick facing to the exterior wall.
Figure 4:
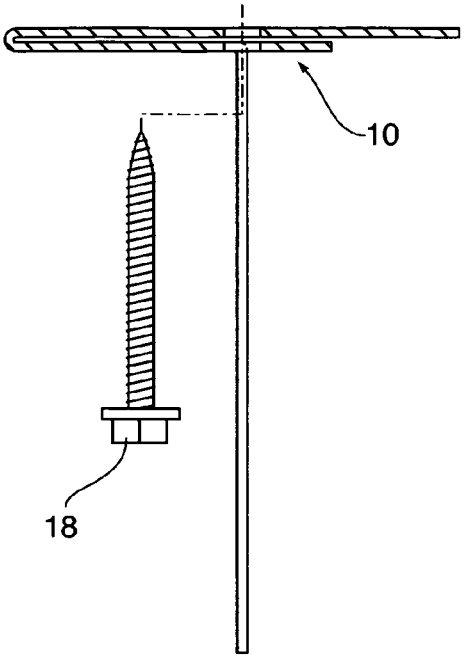
FIG. 4 is a top view partly in cross-section of the flush mount brick veneer anchor of FIG. 1.
Figure 5:
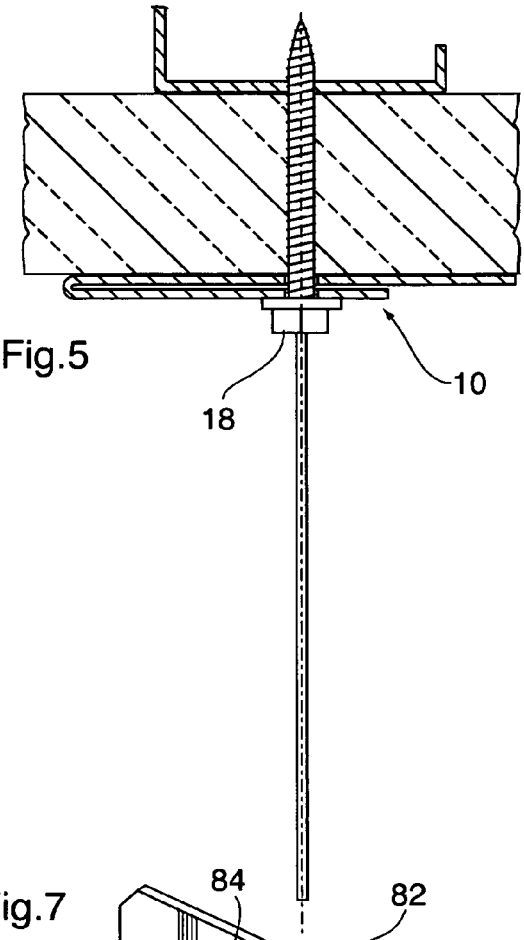
FIG. 5 is a top view partly in cross-section of the flush mount brick veneer anchor of FIG. 1 attached to an exterior wall.

A first embodiment of a flush mount brick veneer anchor of the present invention is illustrated in FIGS. 1 through 5 generally indicated by the numeral 10. The flush mount brick veneer anchor 10 is designed to mount on the exterior covering 12 which is attached to studs 14 making up an exterior wall. The flush mount brick veneer anchor 10 is attached to the exterior wall by screws 18 inserted through mounting holes 20 in the flush mount 30. brick veneer anchor through the exterior covering 12 and into the stud 14 of the exterior wall. In this way the forces exerted on the brick veneer anchor 10 are passed through to the support provided by the studs 14 of the exterior wall by means of the anchoring screws 18.

The flush mount brick veneer anchor of the present invention has an anchoring portion 22 which holds the mounting holes 20 and a tie wire holding portion 24 extending perpendicularly from the anchoring portion 22 and having a slot 26 to hold the tie wire 28 for tying a brick facing 30 to the exterior wall.

In the first embodiment illustrated in FIGS. 1 through 5 the anchoring portion 22 is a doubled up layer of metal with the tie wire holding portion 24 extending perpendicularly from the outer layer of the doubled up metal. This brick veneer anchor 10 is formed of a blank of metal which is cut to the desired size and slit to form the tie wire holding portion and the mounting holes 20 punched out along with the tie wire receiving slot 26 during the initial step of the manufacturing process. The brick veneer anchor 10 is then folded along the fold lines 32 and 34 as shown in FIG. 1 to form the doubled up anchoring portion 22 with the tie wire receiving portion 24 extending perpendicularly from the outer layer of the doubled up anchoring portion 22. Fold line 34 is in line with the mounting holes 20. The two layers of the anchoring portion 22 are then attached to one another, either through spot welding or suitable metal adhesives between the two layers.

FIGS. 2 through 5 illustrate the use of the first embodiment of the flush mount brick veneer anchor 10 of the present invention. The flush mount brick veneer anchor 10 is attached to the exterior surface of the covering by means of suitable fastening means 18 which are driven through the mounting hole 20 and the exterior covering material 12 into. the stud 14 of the exterior wall. A brick tie wire 28 is fed through the tie wire holding opening 26 of the tie wire holding portion 24 and is mortared between bricks of the brick veneer wall to tie the brick veneer wall to the backup wall and to provide an intermediate air space or cavity for air circulation.

Figure 6:
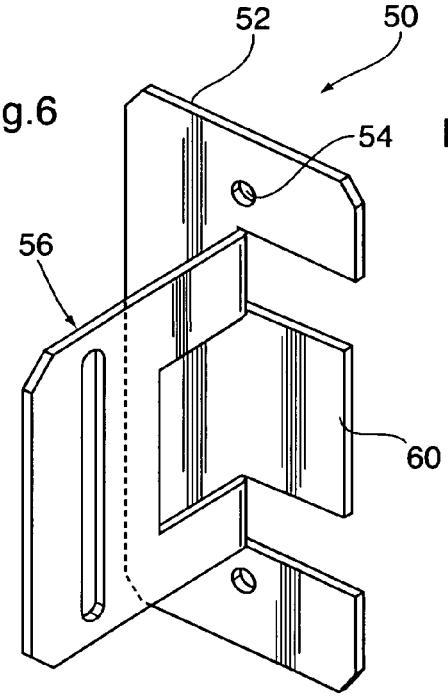
FIG. 6 is a perspective view of the second embodiment of the flush mount brick veneer anchor of the present invention.

A second embodiment of a flush mount brick veneer anchor of the present invention is illustrated in FIG. 6 generally indicated by the numeral 50. This embodiment of the flush mount brick veneer anchor 50 has a single layer anchoring portion 52 which holds the mounting holes 54 and the tie wire holding portion 56 extending perpendicularly from the anchoring portion 52 to hold the tie wire 28 for tying a brick facing to the exterior wall. Similar to the first embodiment, this embodiment of the flush mount brick veneer anchor 50 is formed from a single piece of metal by cutting slits from an edge of the anchoring portion to a bend line in line with the mounting holes 54 and the tie wire holding portion 56 is bent along the bend line perpendicularly away from the anchoring portion. As illustrated in FIG. 6, it is preferred if the anchoring portion is an "E" shape with a central tab 60 centrally located between the edges of the tie wire holding portion 56. Central tab 60 provides for an increase support surface for the anchoring portion 52 against the covering material of the exterior wall.

Figure 7:
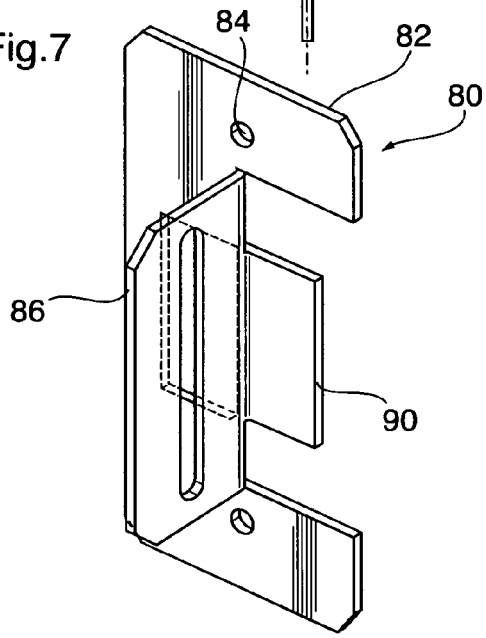
FIG. 7 is a perspective view of a third embodiment of the flush mount brick veneer anchor of the present invention.

A third embodiment of a flush mount brick veneer anchor of the present invention is illustrated in FIG. 7 generally indicated by the numeral 80. Similar to the other embodiments, brick veneer anchor 80 has an anchoring portion 82 which holds the mounting holes 84 and a tie wire holding portion 86 extending perpendicularly from the anchoring portion 82 holding tie wire 28 for tying a brick facing to the exterior wall. Similar to the second embodiment, this embodiment of the brick veneer anchor 80 has an "E" shape with a central tab 90 to increase the support area of the anchoring portion 82 against the surface of the exterior covering of the backup wall. In this embodiment however the central tab is formed by a U cut in the central portion of the anchoring portion 82 to the opposite side of the cuts utilized to form the tie wire holding portion 86. During the bending operation to form the flush mount brick veneer anchor 80 as the tie wire holding portion 86 is bent to extend perpendicularly from the anchoring portion 82, the central tab 90 is bent to be displaced 180° from its original position on the anchoring portion to project to the opposite side of the tie wire holding portion 86. This design of the flush mount brick veneer anchor of the present invention offers an additional advantage in that it requires less metal to be utilized in the construction of the flush mount brick veneer anchor while maintaining the desired support and other advantages of the present invention. This results in the decreased cost of production of the flush mount brick veneer anchor.

The flush mount brick veneer anchor of the present invention provides for mounting holes to attach the brick veneer anchor to a backup wall being aligned with the tie wire holding portion. In this way, any forces exerted through the brick tie wire to the brick veneer anchor and, in particular, the typical compression and extension forces, are transferred directly through the mounting points to the backup wall. This overcomes prior art disadvantages of the anchor plate pivoting about the mounting points under extreme loads and weakening the connection between the anchor plate and the backup wall thus minimizing potential damage to the exterior covering of the backup wall as the anchor plate rotates about the anchor points.

Although various preferred embodiments of the present invention have been described herein in detail, it would be appreciated by those skilled in the art that variations may be made thereto without departing from the spirit of the invention or the scope of the appended claims.

The Embodiments of the Invention in Which an Exclusive Property or Privilege is Claimed are Defined as Follows:

1. A flush mount masonry veneer anchor for mounting on an exterior wall and tying a masonry veneer to the exterior wall, the masonry veneer anchor comprising an anchoring portion with anchor holes to receive a suitable fastener to attach the anchoring portion to an exterior surface of the exterior wall and a tie wire holding portion comprising a single body extending perpendicularly from the anchoring portion, the tie wire holding portion having one end coupled to the anchoring portion and having a slot spaced from said anchoring portion in an opposite end for holding a tie wire at a single point through the single body of the tie wire holding portion for tying the masonry veneer to the exterior wall, the anchor holes being above and below and in line with the tie wire holding portion to transfer extension and compression loads exerted .on the tie wire holding portion directly through fasteners in the anchor holes to the exterior wall without an offset of a plane of the transfer of the forces; and wherein said anchor portion and said tie wire holding portion are an integral monolithic structure.

2. A flush mount masonry veneer anchor according to claim 1 wherein the height of the anchoring portion is greater than the height of the tie wire holding portion and extends above and below the tie wire holding portion, the anchor holes being located in the portion of the anchoring portion above and below and in line with the tie wire holding portion.

3. A flush mount masonry veneer anchor according to claim 2 wherein said anchoring portion includes a first anchor base and an integral second anchor base; said second anchor base is folded back to lie flat against the first anchor base; and said first anchor base, said second anchor base and said tie wire holding portion are an integral monolithic structure.

4. A flush mount masonry veneer anchor according to claim 3 wherein said anchoring portion and said tie wire holding portion are formed of a single sheet of metal and said tie wire portion is bent to a position generally perpendicular to said base portion.

5. A flush mount masonry veneer anchor according to claim 3 wherein said first anchor base and said second anchor base arc fixed together.

6. A flush mount masonry veneer anchor as claimed in claim 5 wherein said first anchor base and said second anchor base are spot welded together.

7. A flush mount masonry veneer anchor as claimed in claim 5 wherein said first anchor base and said second anchor base are fixed together by metal adhesive between an outward directed face of the first anchor base and an inward directed second anchor base.

8. A flush mount masonry veneer for mounting on exterior wall and typing a mansonry veneer to the exterior wall, the mansonry veneer anchor comprising a generally "E-shaped" anchoring portion having a top tab, a central tab and a bottom tab with anchor holes to receive a suitable fastener to attach the anchoring portion to an exterior surface of the exterior wall and a tie wire holding portion comprising a sin le body portion extending perpendicularly from the anchoring portion, the tie wire holding portion having one end coupled to the anchoring portion and having a slot spaced from said. anchor portion in an opposite end for holding a tie wire for tying the masonry veneer to the exterior wall, the anchor holes being above and below and in line with the tie wire holding portion to transfer extension and compression loads exerted on the tie wire holding portion directly through fasteners in the anchor holes to the exterior wall without an offset of a plane of the transfer of the forces; said anchor portion and said tie wire holding portion are an integral monolithic structure; and wherein the height of the anchoring portion is greater than the height of the tie wire holding portion and extends above and below the tie wire holding portion, the anchor holes being located in the portion of the anchoring portion above and below and in line with the tie wire holding portion.

9. A flush mount masonry veneer anchor according to claim 8 wherein said anchoring portion includes a first anchor base and an integral second anchor base; said second anchor base is folded back to lie flat against the first anchor base; and said first anchor base, said second anchor base and said tie wire holding portion are an integral monolithic structure.

10. A flush mount masonry veneer anchor according to claim 9 wherein said anchoring portion and said tie wire holding portion are formed of a single sheet of metal and said tie wire portion is bent to a position generally perpendicular to said base portion.

11. A flush mount masonry veneer anchor according to claim 9 wherein said first anchor base and said second anchor base are fixed together.

12. A flush mount masonry veneer anchor as claimed in claim 11 wherein said first anchor base and said second anchor base arc spot welded together.

* * * * *